US008894553B2

(12) United States Patent
Anderson

(10) Patent No.: US 8,894,553 B2
(45) **Date of Patent: *Nov. 25, 2014**

(54) METHOD FOR ADJUSTING THE WEIGHT-TRAINING MASS OF A WEIGHTPLATE DEVICE

(75) Inventor: Karl Anderson, Glendora, CA (US)

(73) Assignees: Ace Specialty, Inc., Rosemead, CA (US); Grace Premier Fitness and Wellness Products, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/487,431

(22) Filed: Jun. 4, 2012

(65) Prior Publication Data

US 2012/0238417 A1 Sep. 20, 2012

Related U.S. Application Data

(63) Continuation of application No. 12/626,543, filed on Nov. 25, 2009, now Pat. No. 8,210,996, which is a continuation-in-part of application No. 11/425,968, filed on Jun. 22, 2006, now Pat. No. 7,780,582, and a continuation-in-part of application No. 11/425,962, filed on Jun. 22, 2006, now Pat. No. 7,789,813.

(51) Int. Cl.

| | |
|---|---|
| ***A63B 21/075*** | (2006.01) |
| ***A63B 21/072*** | (2006.01) |
| *A63B 21/062* | (2006.01) |

(52) U.S. Cl.

CPC ..... *A63B 21/0728* (2013.01); *A63B 21/0726* (2013.01); *A63B 2021/0623* (2013.01); *A63B 2209/08* (2013.01)

USPC ..... 482/108; 482/106; 482/107

(58) Field of Classification Search

CPC ..... A63B 21/072; A63B 21/0726; A63B 21/0728; A63B 21/075; A63B 2021/0623; A63B 2209/08

USPC ..... 482/44–50, 92–93, 106–109, 148

See application file for complete search history.

(56) References Cited

U.S. PATENT DOCUMENTS

| | | |
|---|---|---|
| 3,320,564 A | 5/1967 | Sosey et al. |
| 3,606,314 A | 9/1971 | Popp |

(Continued)

OTHER PUBLICATIONS

U.S. Appl. No. 11/425,962 (Issued as U.S. 7,789,813 cited above); Office Actions, responses and cited art therein.

(Continued)

*Primary Examiner* — Loan H Thanh
*Assistant Examiner* — Gregory Winter
(74) *Attorney, Agent, or Firm* — Robert A. Seldon

(57) ABSTRACT

A weight plate is added to the exterior of the weight plate mass of a weight plate device so that a magnetic pole region carried by the added weight plate is magnetically coupled to the weight plate mass to magnetically secure the added weight plate to the dumbbell. When decoupling is desired, the added weight plate is rotated with respect to the weight plate mass to bring the carried magnetic pole region into alignment with a magnetically non-attracting portion of the weight plate mass so that the added weight plate can be removed from the weight plate device without overcoming the magnetically-securing coupling force. In a variation of the method, the added weight plate is rotated to bring its carried magnetic pole into sufficient alignment with a pole of like polarity carried by the weight plate mass so that the added weight plate is magnetically repelled.

3 Claims, 8 Drawing Sheets

(56) References Cited

U.S. PATENT DOCUMENTS

| | | | | |
|---|---|---|---|---|
| 4,661,813 | A | 4/1987 | Mazzamauro et al. | |
| 5,014,981 | A * | 5/1991 | Prelich | 482/108 |
| 5,256,121 | A | 10/1993 | Brotman | |
| 5,348,522 | A | 9/1994 | Brotman | |
| 5,407,413 | A | 4/1995 | Kupferman | |
| 5,628,716 | A | 5/1997 | Brice | |
| 5,735,777 | A | 4/1998 | Benoit | |
| 6,872,173 | B2 * | 3/2005 | Krull | 482/108 |
| 7,588,519 | B2 | 9/2009 | McClusky | |
| 7,780,582 | B2 | 8/2010 | Anderson | |
| 7,785,239 | B2 | 8/2010 | Daniels | |
| 7,789,813 | B2 | 9/2010 | Anderson | |
| 2003/0017919 | A1 | 1/2003 | Lanoue | |
| 2007/0298940 | A1 | 12/2007 | Anderson | |

OTHER PUBLICATIONS

U.S. Appl. No. 11/425,968 (Issued as U.S. 7,780,582 cited above); Office Actions, responses and cited art therein.

U.S. Appl. No. 12/626,543; Office Actions, responses and cited art therein.

U.S. Appl. No. 12/841,946; Office Actions, responses and cited art therein.

* cited by examiner

METHOD FOR ADJUSTING THE WEIGHT-TRAINING MASS OF A WEIGHTPLATE DEVICE

CLAIM OF PRIORITY

This is a continuation of U.S. application Ser. No. 12/626,543 filed Nov. 25, 2009, which is a continuation-in-part of U.S. application Ser. No. 11/425,962 filed Jun. 22, 2006 and a continuation-in-part of U.S. application Ser. No. 11/425,968 filed Jun. 22, 2006, the priorities of which are claimed and the contents of which are hereby incorporated by reference.

FIELD OF THE INVENTION

This invention pertains to exercise apparatus of the type employing movable weight plates. Examples of such devices are barbells, dumbbells and cabled devices such as the popular Universal machine that utilize adjustable stacks of weight plates to resist the user's exercise movement. The foregoing equipment shall hereinafter be collectively referred to as "weight plate devices", and the term "weight plate device" will be utilized to refer to one or more of them.

There are two fundamental types of dumbbells and barbells: the "fixed weight" type, wherein the weight plates are permanently secured on the ends of a bar, and the "adjustable" type, wherein weight plates are secured on the bar by removable collars that permit the user to add or remove individual weight plates to the bar. The fixed weight type is typically part of a set wherein a plurality of dumbbells (or barbells) provide a range of weights typically separated by 5 lb. increments.

Typically, it is desirable to have an easily and quickly mountable and detachable weight plate that can be used to selectively add or subtract incremental weight to a pre-existing weight plate combination or other pre-existing weight-training mass. For simplicity, this easily mountable and detachable weight plate will be referred to as an "incremental" weight plate because (as will become clear) it is used to incrementally vary the weight to be lifted. In some cases, the incremental weight is quite small; e.g., 0.25 to 2.5 lbs. In other cases, it can be greater or smaller. Generally, incremental weights are used to rehabilitate injured muscles and ligaments, wherein small increases/decreases in resistance are needed in the course of rehabilitation exercises. In other cases, small incremental weights are useful where the user is exercising smaller muscle groups, or is older or physically weak, or has reached a "plateau" that is preventing a major increase to the next full increment of lifted poundage.

The use of magnetically mountable incremental weights is known as one means to quickly and conveniently add and subtract such weight. For example, U.S. Pat. No. 5,735,777 describes the use and application of magnetic "adaptive weights" that are removably attached to dumbbells and barbells. The content of that patent is hereby incorporated by reference.

The advantages of magnetically coupled incremental weights have been offset by a number of deficiencies. First, they have not been usable with non-metallic weight plates although many dumbbells and barbells utilize plastic weight plates or plates made of other non-magnetic material. In addition to being less expensive to manufacture, plastic and rubber weight plates are less prone to cause chipping, marring and other surface damage to surrounding gym equipment such as racks and neighboring devices, and are less prone to damage inadvertently contacted woodwork and walls. Accordingly, the inability to use magnetically coupled incremental weight plates with increasingly popular non-magnetic dumbbell and barbell weight plates is a severe limitation.

Secondly, there has been a need for strong magnetic attraction between the incremental weight plate and the dumbbell/barbell weight plate to which it is attached. In addition to safety concerns that arise whenever a weight plate can fall from an exercise device, it is undesirable for the incremental weight to shift position during an exercise movement because the resulting imbalance can detract from the safety and efficacy of the exercise movement. The strong magnetic attraction thus required not only makes it difficult to remove the incremental weight plate from the exercise device, but can also scratch or mar the weight plate surface to which the incremental weight attaches. Moreover, magnetic incremental weights are coupled to coated weight plates on some weight plate devices, and the decoupling effort can scratch or mar the coating, leading to the rusting of the underlying surface.

As hereinafter used, the term "dumbbell" shall include dumbbells and barbells.

SUMMARY OF THE INVENTION

A method for adjusting the weight-training mass of a weightplate device is disclosed herein. The method comprises the steps of (a) mounting an added weight plate to the exterior surface of the weightplate mass so that a magnetic pole region carried by the added weight plate is magnetically coupled to the weight plate mass to magnetically secure the added weight plate to the dumbbell, and (b) rotating the added weight plate with respect to the weight plate mass, when decoupling is desired, to bring the carried magnetic pole region into alignment with a magnetically non-attracting portion of the weight plate mass so that the added weight plate can be removed from the weightplate device from without overcoming the magnetically-securing coupling force.

When, for example, the weight-training device is a dumbbell including a bar that extends generally axially between opposing end regions, a weight plate mass mounted about the bar at each end region, means for retaining the mounted weight plate mass at the respective end regions to define a handle region axially inward of the end regions that can be gripped by a user during exercise movement of the dumbbell, and means for mechanically securing the weight plate mass at each end region to the dumbbell, the method comprises the steps of (a) mounting an added weight plate axially outward of the weight plate mass at each end region so that a magnetic pole region carried by the added weight plate is magnetically coupled to the weight plate mass to magnetically secure the added weight plate to the dumbbell, and (b) rotating the added weight plate with respect to the weight plate mass, when decoupling is desired, to bring the carried magnetic pole region into alignment with a magnetically non-attracting portion of the weight plate mass so that the added weight plate can be removed from the dumbbell without overcoming the magnetically-securing coupling force.

These and further details of the invention will be apparent to those of ordinary skill in the art from reading a description of the preferred embodiment of the invention described below, and of which the drawing forms a part.

DESCRIPTION OF THE DRAWING DRAWINGS

DESCRIPTION OF THE PREFERRED EMBODIMENT

Figure 1:
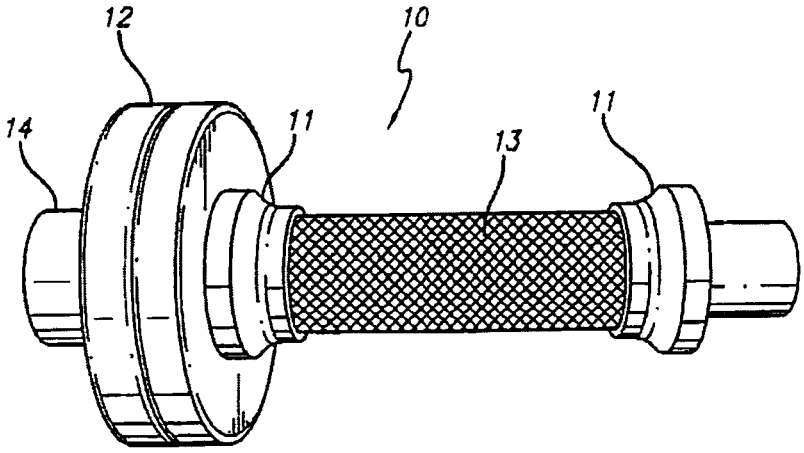
FIG. 1 is a front elevation view showing one end of a dumbbell constructed in accordance with the invention herein.

FIG. 1 is a front elevation view showing one end of a "fixed weight" type dumbbell 10 constructed in accordance with the invention. Although the invention is discussed in the context of a dumbbell, it should be recognized that barbells are within the scope of the invention and the term "dumbbell" will be used to denote both devices.

The dumbbell 10 has a weight plate mass comprising, in the illustrated embodiment, two generally annular weight plates 12 respectively mounted in the conventional manner at opposite end regions of a longitudinally-extending bar 14 and mechanically secured thereto in the conventional manner as, for example, as by press fitting the plates onto the bar and/or welding or bolting them in place. In FIG. 1, only the left weight plates 12 are shown, the right weight plate having been omitted for the purpose of illustration. In practice, a plurality of weight plates may be mounted at each end region to achieve the desired weight, or a single weight plate may be utilized at each end region. The end portion of the bar 14 extends through and beyond the outermost weight plate 12. The weight plates abut respective collars 11 which are located at longitudinally opposed positions on bar 14 to define a handle region 13 therebetween that is gripped by the user. The weight plates 12 may be formed (at least in part) from a magnetically responsive material such as iron or steel. The axially outermost of the plates 12 at each end region may be weight plates intended to significantly contribute to the weight of the dumbbell (as do conventional weight plates) or they may be of comparatively insubstantial weight (see, for example, plate 42 in FIG. 15) intended only to provide the magnetic coupling and/or decoupling feature as hereinafter described. As described herein, the axially outermost weight plates 12 will be illustrated and described as a weight plate, but those of ordinary skill in the art will recognize that it need not be a significant, or even noticeable, contributor to the weight of the dumbbell.

Figure 2:
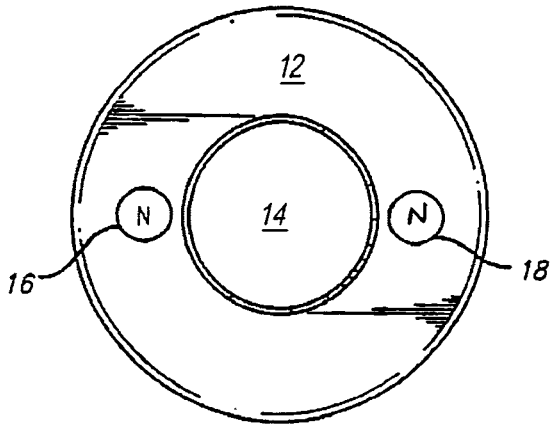
FIG. 2 is a left side elevation view of the dumbbell of FIG. 1.

FIG. 2 is a left side elevation view of the dumbbell of FIG. 1. A pair of magnets 16, 18 are associated with the weight plate mass; magnets 16, 18 are embedded in the outermost surface of the plate 12 at both ends of the dumbbell. The magnets are preferably of the rare earth type, such as neodymium magnets. These are very strong magnets that can be relied upon to securely bind a magnetically-responsive incremental weight plate to the dumbbell. While two magnets 16, 18 are shown in diametrically opposite positions, any other number of magnets could be used, and other positions could be utilized without departing from the scope of the invention.

In the configuration illustrated in FIG. 2, the magnets 16, 18 have poles of like polarity facing axially outward; i.e., their North poles. As will become clear, however, both magnets can instead have their South poles facing axially outward, or each can have a different pole facing axially outward without departing from the scope of the invention. Also, as will become clear, the number of magnets is not limited to "two", but can be any number, and their respective outwardly-facing poles can be North poles, South poles, or a mix thereof that accomplishes the purposes hereinafter described. Lastly, one of ordinary skill in the art will recognize that the axially outermost plate 12 can be of any thickness or cross-dimension, and can be fabricated to provide a standardized amount of weight (or negligible weight) to each dumbbell on which it is placed, thereby enabling that same magnet-bearing plate to be used in the fabrication of dumbbells of different weights.

Figure 3:
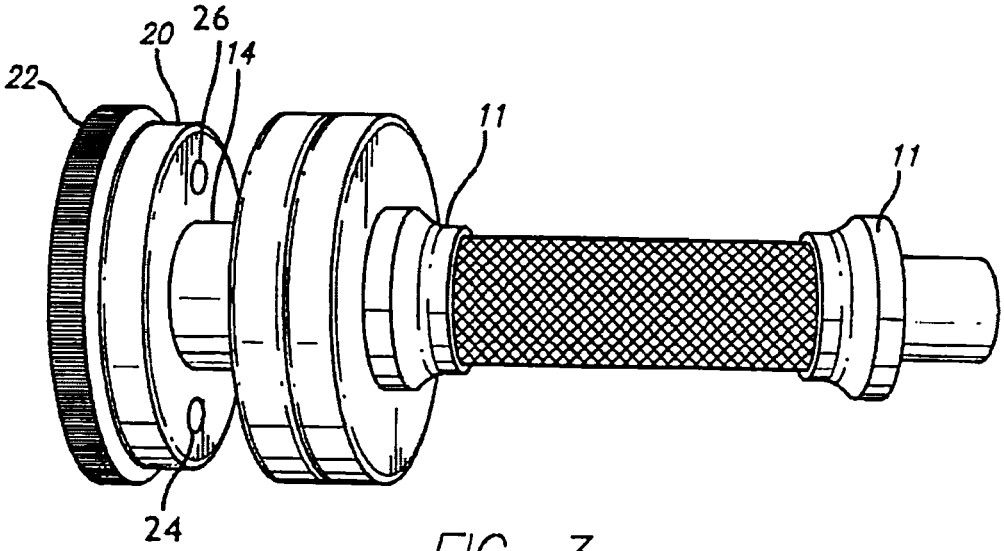
FIG. 3 is a front elevation view of the dumbbell illustrated in FIG. 1 with an added incremental weight plate mounted onto its bar in accordance with the invention.

The dumbbell illustrated in FIGS. 1 and 2 has a "base weight" to which an incremental weight plate of desired poundage is to be added. FIG. 3 is a front elevation view of the dumbbell of FIG. 1, but showing an incremental weight plate 20 of incremental poundage mounted onto the outwardly extending portion of the bar 14. The incremental weight plate 20 preferably includes an integrally formed knurled portion 22 that can be of relatively larger diameter, if desired, which provides a graspable periphery preferably sized to be encompassed by the human hand so that the incremental weight plate 20 can be rotated with one hand in the manner of a jar-top.

Figure 4:
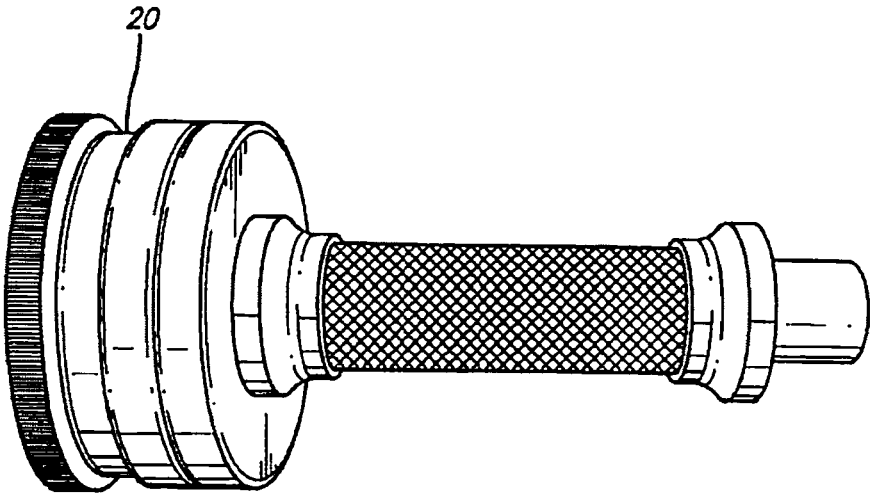
FIG. 4 is a front elevation view of the dumbbell of FIG. 1 with the incremental weight plate fully mounted.
Figure 5:
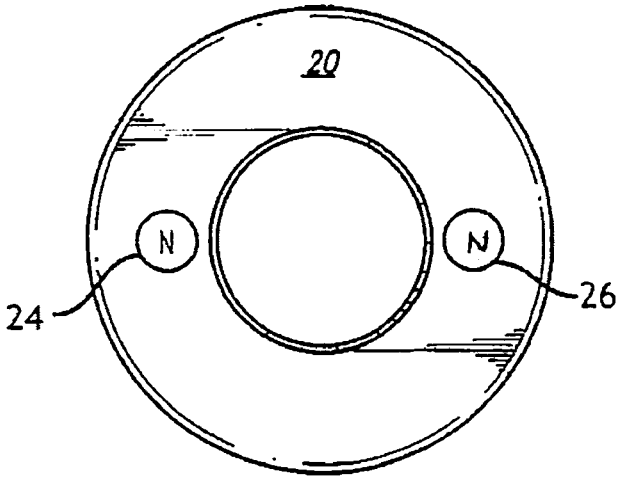
FIG. 5 is a right side elevation view of the incremental weight plate shown in FIG. 4.
Figure 7:
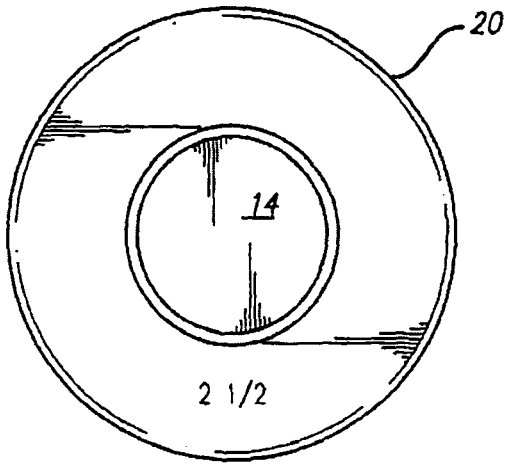
FIG. 7 is a left side elevation view of the dumbbell of FIG. 6.

FIG. 4 is a front elevation view of the dumbbell of FIG. 1 with the incremental weight plate fully mounted. FIG. 5 is a right side elevation view of an incremental weight plate constructed in accordance with the invention. This is the axially inwardly-facing surface of the incremental weight plate 20 of the dumbbell depicted in FIGS. 1-4; i.e., the surface that faces and engages the weight plate 12. As illustrated in FIGS. 3-5, the incremental weight plate 20 is preferably generally annular, so as to fit concentrically about the bar 14. The incremental weight is thereby balanced with respect to the bar, as is preferable for most lifting movements. Naturally, other shaped plates or non-concentric mountings can be provided if an unbalanced arrangement is desired. As further illustrated in FIG. 7, indicia can be stamped, molded or otherwise placed upon the incremental weight plate to display its added incrementally poundage; in this case, "2½" indicates that the incremental weight plate 20 ways 2½ pounds.

As shown in FIGS. 3 and 5, the incremental weight plate 20 includes a pair of magnets 24, 26 that are embedded in the incremental weight plate and positioned to generally overlie the magnets 16, 18 when the incremental weight plate is mounted onto the bar 14 and rotated into a "decoupling" position as described below. The term "generally overlie" means that the magnets are sufficiently adjacent to create the desired magnetic interaction between them. While the magnets 24, 26 have axially inward-facing North poles in FIG. 5, it should be understood that this is the case because the magnets 16, 18 of the dumbbell mass (FIG. 2) have axially outward-facing North poles. Generally, this variant of the invention contemplates only that the dumbbell magnets magnetically repel the incremental weight plate magnets when the latter are brought into substantially overlying relationship with the former so that the incremental weight plate will be magnetically repelled from the dumbbell mass.

Figure 6:
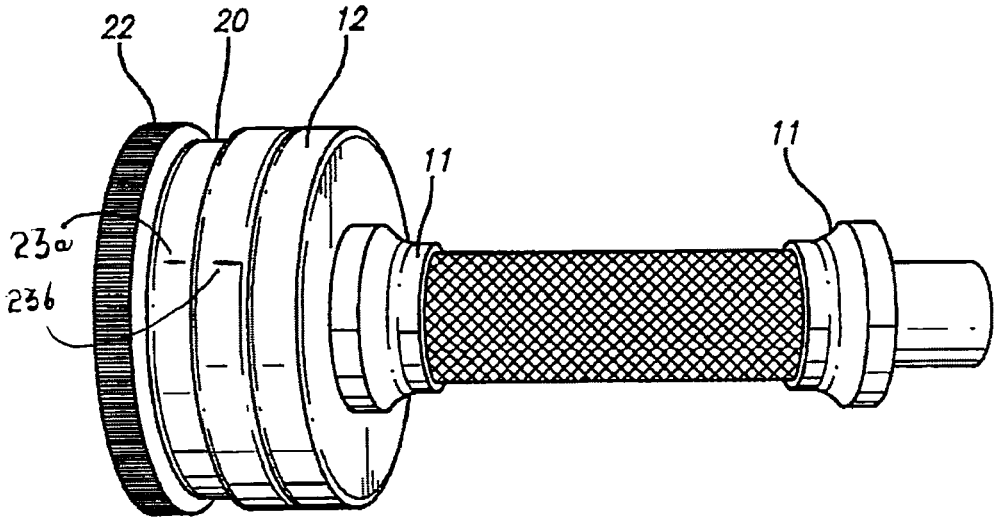
FIG. 6 is a front elevation view of the dumbbell of FIG. 1 with the incremental weight plate fully mounted.

When the incremental weight plate is mounted on to the bar 14, and positioned so that its magnets do not interact with respective like poles of the dumbbell mass, the incremental weight plate 20 becomes magnetically secured to the magnetically responsive plate 12 (and thereby to the dumbbell) without the need for a collar. When the user wishes to decouple the incremental weight plate 20 from the dumbbell, the user merely grips and rotates the outer knurled periphery of the incremental weight plate with one hand, in the manner by which a jar top is gripped and rotated. The incremental weight plate 20 is then rotated about the bar 14 until the magnets 24, 26 interact with the magnets 16, 18 and are magnetically repelled so that the incremental weight plate seemingly "pops off" the dumbbell. The user need only have applied a relatively easy twisting motion to the incremental weight plate 20 rather then pulling the plates apart. For convenience, the incremental weight plate can be marked with a symbol that, when lined up or otherwise correlated with a symbol on the dumbbell as the incremental weight plate is rotated, indicates the decoupling position to the user. In its simplest form, a line 23*a* (FIG. 6) or dot on the perimeter of the incremental weight plate can be rotated into alignment with a line 23*b* or dot on the periphery of the plate 12.

The magnets 24, 26 that have been successfully used are 0.5 inches in diameter and 0.5 inches in length, with a tolerance of 0.005 inches. They are slip-fit into respective bore holes in the incremental weight plate, and the top of the bore walls are center punched radially inward around their peripheries to entrap the magnets within the bores.

To prevent the rotated magnets from marring the surfaces of the weight plates 12 and the incremental weight plates 20, the magnets are preferably recessed from the surfaces of the respective plates by 10 thousandths of an inch or so.

Those skilled in the art will recognize that a greater number of magnets could be used, and that they can be positioned differently than those shown in the Figures. Regardless of the number of magnets or their respective positions, the magnets are utilized to attract or repel the incremental weight plate.

The use of mutually attracting magnets can provide for a more secure coupling of the incremental weight plate to the dumbbell than the aforedescribed coupling to the plate 12's magnetically responsive material, yielding a greater safety factor and/or permitting weaker and perhaps less expensive magnets to be used. In another magnetic arrangement, magnets of the incremental weight plate and dumbbell are accordingly oriented and positioned to magnetically attract each other when the incremental weight plate is mounted onto the dumbbell in a first (or "securing") position, and magnetically repel each other when the incremental weight plate is rotated to a second (or "decoupling") position. In the first position, one or more axially-inward facing poles of the magnets in the incremental weight plate magnetically couple to axially-outward facing poles of opposite polarity of magnets associated with the weight plate 12 that they generally overlie; for example, axially inward-facing North poles in the incremental weight plate face axially-outward South poles of the weight plate 12. In the decoupling position, the axially-inward facing poles of the magnets in the incremental weight plate face magnets associated with the weight plate 12 that have like magnetic polarities; for example, axially inward-facing North poles in the incremental weight plate face axially-outward North poles of the weight plate 12. As few as three magnets can be used, with either the weight plate 12 or the incremental weight plate having one magnet having either a North pole or South pole, and the other of the two plates having two magnets: one with a South pole and one with a North pole. Thus one paired coupling will attract the incremental weight plate to the dumbbell, and the other paired coupling will magnetically repel the incremental weight plate from the dumbbell. More magnets can be used with their respective poles positioned and oriented to accomplish the foregoing functions.

Figure 8:
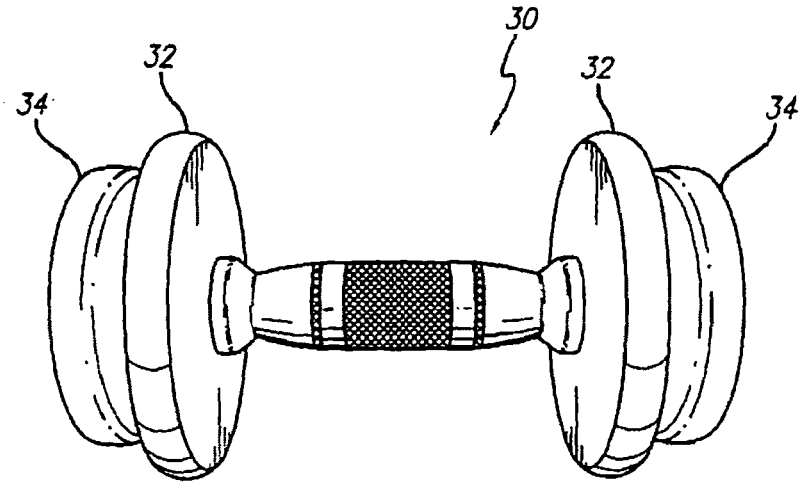
FIG. 8 is a front elevation view of a second embodiment of a dumbbell constructed in accordance with the invention.
Figure 9:
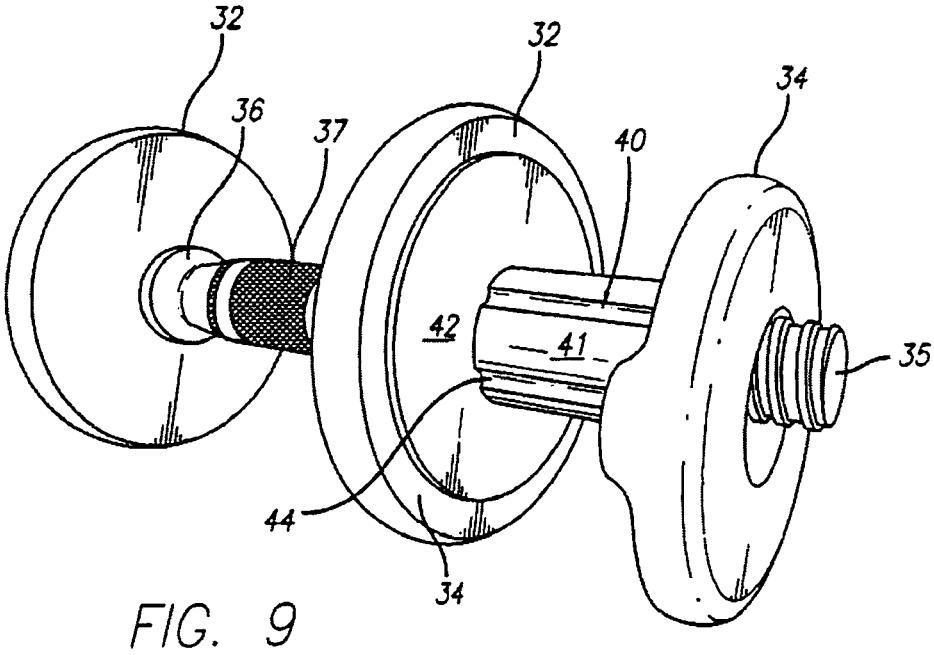
FIG. 9 is a front perspective elevation view of the dumbbell of FIG. 8, showing the incremental weight plate positioned for mounting onto the dumbbell in accordance with the invention.
Figure 10:
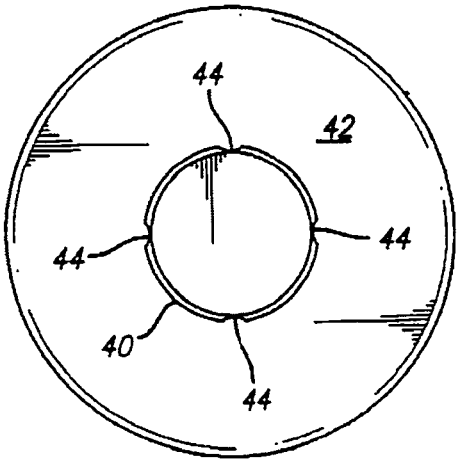
FIG. 10 is a right side elevation view of the plate and sleeve of FIG. 8.

Another variant of a dumbbell constructed in accordance with the invention is shown in FIGS. 8-11. FIG. 8 is a front elevation view of a dumbbell 30 of the "adjustable" type, wherein weight plates have conventionally been mechanically secured on the bar by removable collars that permit the user to add or remove individual weight plates to the dumbbell. FIG. 9 is a front perspective elevation view of the dumbbell of FIG. 8, and FIG. 10 is a side elevation view of the dumbbell of FIG. 8, showing an incremental weight plate 34 mounted onto the dumbbell in accordance with the invention.

In this embodiment, the bar 35 is of the known externally-threaded variety. Conventionally, weight plates are mounted on the bar and urged toward the dumbbell's handle until stopped by the collar 36 or a previously mounted weight plate. An internally threaded nut or other such fastening device is then rotated onto the bar until securing contact is made with the outermost weight plate.

As illustrated in FIGS. 8-9, the outer weight plates 32 and incremental weight plates 34 are mounted at opposite end regions of an externally threaded bar 35 that extends through the dumbbell handle 37. As will become clear, the outer weight plates 32 of the weight plate mass need not be magnetically responsive but can, instead, be made of polyurethane or other commonly utilized plastic material such as that found in less expensive dumbbell sets.

In accordance with the invention, and as best shown in FIGS. 9 and 10, a sleeve 40 is mounted to the bar 35. The sleeve preferably has a "T"-shaped cross-section, comprising an internally-threaded generally cylindrical portion 41 that is tightened onto the externally threaded bar 35, so that a leading plate portion 42 of relatively greater diameter butts up against the outer weight plate 32 to mechanically secure the weight plate 32 to the bar. The cylindrical portion 41 provides a relatively smooth mounting surface for the incremental weight plate, preventing the mounting operation from being adversely affected by the discontinuous surface created by the external threads of the shaft 35.

Those of ordinary skill in the art will recognize that the plate portion 42 need not be integral with the cylindrical portion 41; where the two are separate components, a plate 42 can simply be mounted about the bar 35, and an internally threaded sleeve 41 can be tightened onto the externally threaded bar 35 until the plate 42 is secured against the outermost weight plate 32. It will hereinafter be understood that the term 'plate portion 42" will be used to refer to both the plate portion of the sleeve 40 and the alternative separate plate, while the term "cylindrical portion" will likewise be used to refer to both the cylindrical portion 41 of the sleeve 40 and the separate sleeve 41 just described.

Figure 11:
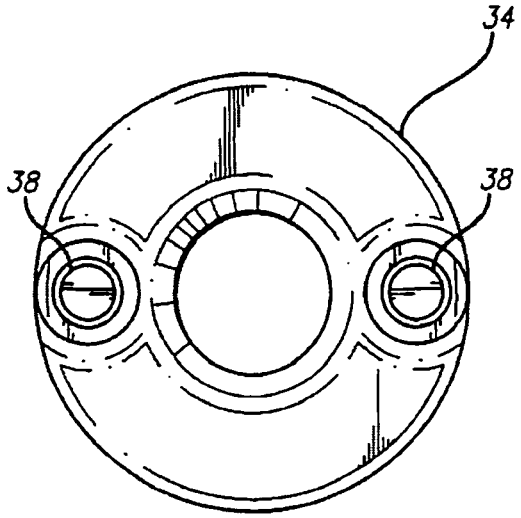
FIG. 11 is a left side elevation view of the right incremental weight plate illustrated in FIG. 9.

Depending on the specific embodiment, the plate portion permits one or more magnetic regions, one or more magnetically-responsive regions, and/or one or more nonmagnetically-responsive regions to be associated with the weight plate mass even where the weighplate mass is formed from a non-magnetic material or has a nonmagnetic coating that renders the mass weakly magnetically-responsive or magnetically non-responsive. In one variant of the plate portion 42, the plate portion 42 is formed at least partially from magnetically responsive material so that the incremental weight plate becomes magnetically secured to the plate portion 42 when mounted on the dumbbell even if the weight plate 32 is non-magnetically responsive. (It will also be recognized by those of ordinary skill in the art that a relatively thin plate similar to plate portion 42 can be utilized on a "fixed weight" dumbbell such as that illustrated in FIGS. 1-6 if one wishes to use non-magnetic material or non-magnetic coatings to form at the axially outermost weight plate 12 thereof.) The incremental weight plate is are accordingly provided with one or more magnetic regions, such as magnets 38 (FIG. 11) that secure the incremental weight plate to the plate portion and, thereby, to the dumbbell. FIG. 11 is a left side elevation view of the right incremental weight plate 34 of FIG. 8, showing two magnets 38. As before, and as preferred, the magnets have like poles facing the dumbbell; i.e., each has its North pole facing the dumbbell, or each has its South pole facing the dumbbell.

Figure 15:
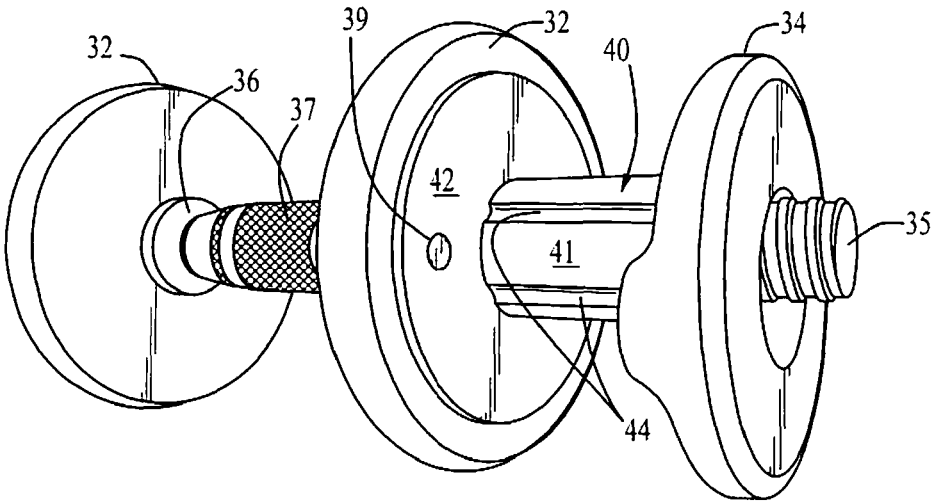

A second variant of the plate portion 42 is formed from a non-magnetic material, but includes separate regions of magnetically responsive material embedded therein that are positioned to interact magnetically with the incremental weight plate 34 (FIG. 11) when the incremental weight plate is mounted onto the bar. In FIG. 15, for example, the region 39 is positioned to magnetically interact with the incremental weight plate 34. There may be one or more such magnetically responsive regions 39; preferably, there is a second such region diametrically opposite the magnetic region 39 visible in FIG. 15 but hidden from view in that Figure by the sleeve 40. The region(s) 39 is positioned to magnetically interact with the regions 38 (FIG. 11) when a region 38 is adjacent to a region 39. At least one of that adjacent pair must be a magnet, with the other of the adjacent pair being either a magnet of opposite polarity or simply magnetically-responsive material. Thus, for example, region 39 may be a region of magnetically-responsive material, while region 38 (FIG. 11) is a magnet. When the incremental weight plate 34 is mounted on the bar with region 39 adjacent region 38, the incremental weight plate is magnetically secured to the dumbbell. When the incremental weight plate is rotated about the shaft 35 to move region 38 away from region 39 until the regions are magnetically uncoupled, the incremental weight plates can be manually removed from the dumbbell without the need to physically overcome the magnetic attraction that secured the incremental weight plate to the dumbbell. Naturally, the magnet(s) can be located in the plate portion 42, with magnetically responsive and non-magnetically responsive regions being positioned on the incremental weight plate to achieve the same result. Those skilled in the art will recognize that the magnetically responsive and non-magnetically responsive regions can be of any shape, dimension and location that achieves the described effect, and that any number of such regions may be utilized on the plate and on the incremental weight plate that achieves that effect.

In a third variant of the plate portion 42, both the plate portion and the incremental weight plate are provided with magnets whose poles selectively cause magnetic attraction and magnetic repulsion of the incremental weight plate with respect to the dumbbell, depending upon the rotational position of the incremental weight plate about the bar. Accordingly, the plate portion 42 and the incremental weight plate 34 of this variant each include at least one magnet oriented and positioned to experience magnetic repulsion when the incremental weight plate is rotated about the bar into a decoupling position that rotates its magnet into a position substantially adjacent the plate portion's magnet. By way of example, if the region 39 (FIG. 15) represents a magnet having an axially outward-facing North pole and the incremental weight plate 34 has a magnet 38 (FIG. 11) with an axially inward-facing North pole, the region 39 magnetically secures the incremental weight plate to the dumbbell, when the incremental weight plate 34 is magnetically attracted to magnetically responsive material associated with the plate portion 42 (or to a magnet associated with plate portion 42 that has an axially-outward facing South pole). The incremental weight plate can then be rotated about the bar 35 into a decoupling position, wherein the magnetic North poles of regions 39 and 38 interact, repelling the incremental weight plate 34 from the plate portion 42.

Thus, the plate portion 42 and/or incremental weight plate 34 may also be provided with magnets presenting North and South poles to the other so that a rotation of the incremental weight plate creates one or more coupling and decoupling positions. For example, as illustrated in FIG. 15, the plate portion 42 can include two magnets 39 that respectively present a North and a South pole to the magnets of the incremental weight plate 34 for the coupling/decoupling effect previously described. A given magnetic pole associated with the plate portion 42 will attract one of the magnets 39, and repel the other, thereby providing both magnetic attraction and magnetic repulsion.

Again, those of ordinary skill in the art will recognize that any number of magnets, locations and orientations can be used to achieve the foregoing effect. For example, two magnets may be placed 180° apart (or less) or four magnets may be placed 90° apart (or less) to reduce the degree of rotation needed to reach a decoupling position.

Regardless of the particular magnetic arrangement chosen, the plate portion 42 provides a magnetically responsive seat for the incremental weight plate 34 regardless of whether the axially outer weight plate 32 is made of magnetically-responsive material or not. Further, the plate portion 42 provides a wear surface that prevents the axially outer weight plate 32 from being marred or damaged by the incremental plate 34, particularly when the outer plate 32 is plated or coated with an aesthetically pleasing layer of material.

The sleeve 40 may, if desired, be tightened onto the bar 35 by mounting the sleeve and magnetically coupled incremental weight plate 34 together as a unit, and utilizing the incremental plate 34 as a handle in a jar-lid tightening manner. To enable the sleeve 40 to be more firmly tightened onto the bar, however, a series of longitudinally-extending grooves 44 are preferably formed in the cylindrical portion 41 of the sleeve for gripping by complimentary surfaces of a tightening tool. This is best shown in FIG. 10, which is a right side elevation view of the sleeve 40.

Figure 12:
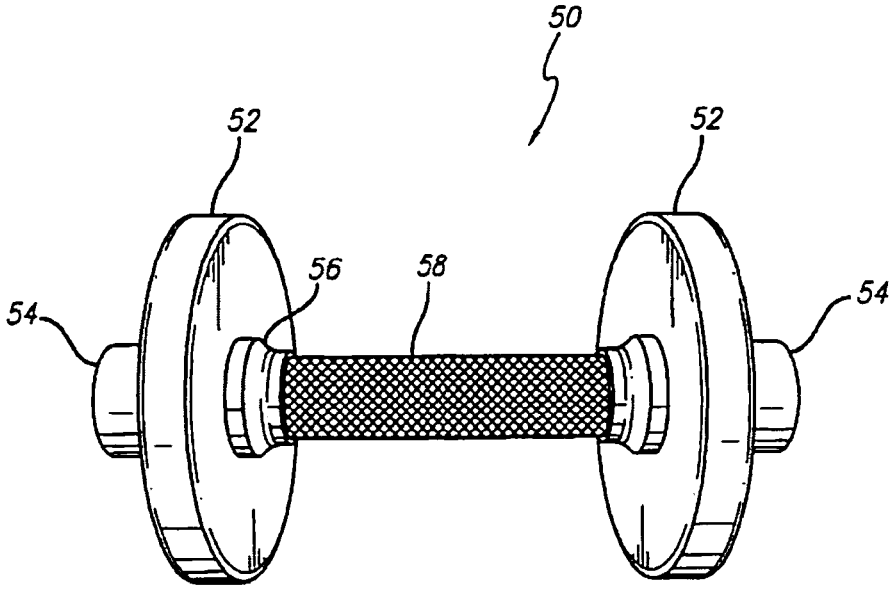
FIG. 12 is a front elevation view of a dumbbell constructed in accordance with a third embodiment of the invention.
Figure 13:
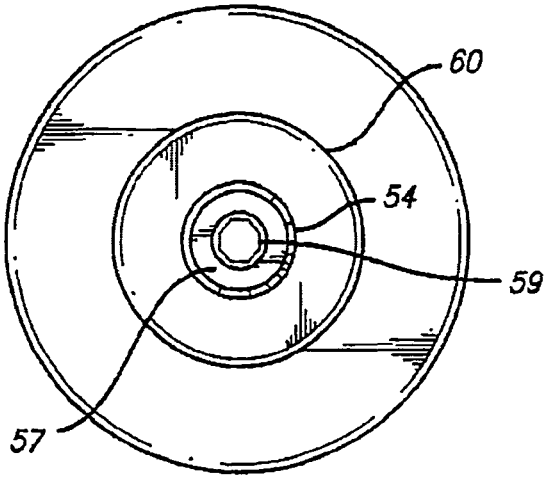
FIG. 13 is a left side elevation view of the dumbbell of FIG. 12.

FIG. 12 illustrates another embodiment of the invention. FIG. 12 is a front elevation view of a dumbbell of the "fixed weight" type, wherein weight plates 52 are permanently secured on the ends of a bar that extends through the dumbbell handle 58. FIG. 13 is a side elevation view of the dumbbell of FIG. 12. Again, the weight plates 52 may be magnetically responsive or not. A plate 60 having one or more magnetically-responsive regions is secured to the dumbbell at each end region of the dumbbell between the axially outermost weight plate 52 and a generally annular, longitudinally-extending cylindrical sleeve 54. The plate 60 has a relatively larger diameter than the sleeve 54, and the two are preferably formed as an inter-pole piece. The sleeve is secured to the dumbbell via a respective hex bolt 59 that is inserted into the end 57 of the sleeve 54, extends through the sleeve and threads into an internally threaded end region of the bar, thereby securing the sleeve 54, plate 60 and weight plate 52 against respective collars 56 located at each end of the handle 58. Incremental weight plates can then be added and removed as described above, preferably but not necessarily utilizing magnets in the plate 60 to repel the incremental weight plate when the incremental weight plate is rotated to bring its magnet(s) into general alignment with the like-pole of opposing respective magnet(s) in the plate 60.

Figure 14:
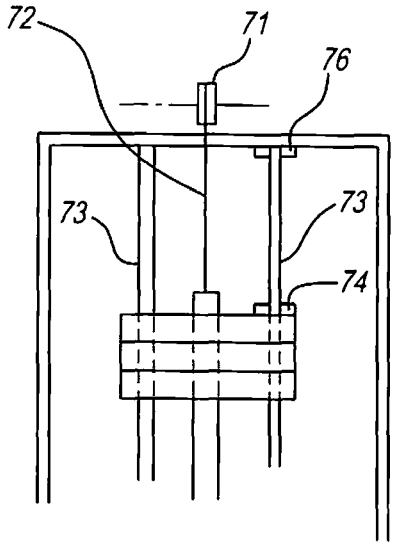
FIG. 14 is a rear elevation view in schematic of a cabled exercise device constructed in accordance with a fourth embodiment of the invention and FIG. 15 is a perspective view of another embodiment of a dumbbell constructed in accordance with the invention.

The invention herein is not limited to dumbbells or barbells. It can, for example, be applied to cable-type exercise equipment. FIG. 14 is a rear elevation view in schematic of a cabled exercise device constructed in accordance with a fourth embodiment of the invention. An adjustable stack of weight plates 70 is lifted by a user who is pulling them upward by a cable 72 via a pulley 71 or other means known in the art. The stack of weight plates is guided by guide rods 73, which guide the stack's movement vertically, and keep the plates evenly stacked as they move. "Sleeves" with magnetically-responsive base portions may be affixed, as at 74, to the topmost weight plate to accommodate incremental weight plates, thereby offering a total poundage that falls between the increments of weight offered by the stack. The base portions of the "sleeves" may include magnets, as described above, to repel the incremental weight plate when the incremental weight plate is appropriately rotated, or the sleeve. The "sleeves" need not be annular in this application, and the term "sleeve" has been used only for consistency of terminology with respect to embodiments described above.

Alternatively, the "sleeves" of this embodiment can be positioned as at 76, with the incremental weight plates being held magnetically above the stack until needed, and then being selectively decoupled from the "respective" sleeve and guided vertically about the respective guide rod 73 from the "sleeve" to the weight plate stack. Once again, the decoupling action can be purely manual, or the "sleeves" can include magnets in their base portions to repel the incremental weight plate when the incremental weight plate is suitable rotated, as described earlier.

Although the present invention and its advantages have been described in detail, it should be understood that various changes, substitutions and alterations can be made herein without departing from the spirit and scope of the invention as will be defined by appended claims.

I claim:

1. A method for adjusting the weight of a dumbbell of the type including:

a bar that extends generally axially between opposing end regions, a weight plate mass mounted about the bar at each end region, said mounted weight plate masses being retained at the respective end regions to define a handle region axially inward of the end regions that can be gripped by a user during exercise movement of the dumbbell, and said weight plate masses being mechanically secured at a respective end region to the dumbbell, wherein the method comprises the steps of:

mounting an added weight plate axially outward of the weight plate mass at each end region so that a magnetic pole region carried by the added weight plate is magnetically coupled to the weight plate mass to magnetically secure the added weight plate to the dumbbell via a magnetically-securing coupling force, and rotating the added weight plate with respect to the weight plate mass, when decoupling is desired, to bring the carried magnetic pole region sufficiently into alignment with a magnetic pole region of like polarity carried by the weight plate mass so that the added weight plate is magnetically repelled from the weight plate mass.

2. The method of claim 1 wherein the added weight plate has a bar-accepting through-hole through which the added weight plate is mounted about the bar for rotation between a position in which it is magnetically secured to the dumbbell and a position in which it is magnetically repelled from the weight plate mass.

3. A method for adjusting the weight-training mass of a weight plate device having a movable weight plate mass comprising the steps of:

mounting an added weight plate to the exterior surface of the weight plate mass so that a magnetic pole region carried by the added weight plate is magnetically coupled to the weight plate mass via a magnetically-securing coupling force to magnetically secure the added weight plate to the weight plate device, and rotating the added weight plate with respect to the weight plate mass, when decoupling is desired, to bring the carried magnetic pole region into alignment with a magnetic pole region of like polarity carried by the weight plate mass so that the added weight plate is magnetically repelled from the weight plate mass so that the added weight plate can be removed from the weight plate device without overcoming the magnetically-securing coupling force.

* * * * *